US010047993B2

(12) United States Patent
Okada et al.

(10) Patent No.: US 10,047,993 B2
(45) Date of Patent: Aug. 14, 2018

(54) ENGINE DRIVEN HEAT PUMP

(71) Applicant: YANMAR CO., LTD., Osaka-shi (JP)

(72) Inventors: Hideshi Okada, Osaka (JP); Kyoko Hashimoto, Osaka (JP)

(73) Assignee: YANMAR CO., LTD., Osaka-shi (JP)

( * ) Notice: Subject to any disclaimer, the term of this patent is extended or adjusted under 35 U.S.C. 154(b) by 618 days.

(21) Appl. No.: 14/561,704

(22) Filed: Dec. 5, 2014

(65) Prior Publication Data

US 2015/0184904 A1 Jul. 2, 2015

(30) Foreign Application Priority Data

Dec. 27, 2013 (JP) ..... 2013-272908

(51) Int. Cl.
*F25B 27/02* (2006.01)
*F25B 49/02* (2006.01)
(Continued)

(52) U.S. Cl.
CPC ..... *F25B 49/025* (2013.01); *F25B 27/00* (2013.01); *F25B 13/00* (2013.01); *F25B 49/005* (2013.01);
(Continued)

(58) Field of Classification Search
CPC ..... F25B 49/025; F25B 27/00; F25B 13/00; F25B 49/005; F25B 2313/02741;
(Continued)

(56) References Cited

U.S. PATENT DOCUMENTS 4,257,238 A * 3/1981 Kountz ..... F24F 11/0009 62/176.3
4,991,400 A * 2/1991 Wilkinson ..... F25B 27/00 62/228.4
(Continued)

FOREIGN PATENT DOCUMENTS

JP 2004316934 A * 11/2004
JP 4682558 B2 5/2011
JP 2012-229899 A 11/2012
JP 2015-059688 A 3/2015

OTHER PUBLICATIONS

Office Action dated Dec. 20, 2016, issued for the Japanese patent application No. 2013-272908.

*Primary Examiner* — Jianying Atkisson
*Assistant Examiner* — Paul Schwarzenberg
(74) *Attorney, Agent, or Firm* — Locke Lord LLP

(57) ABSTRACT

An engine driven heat pump includes an outdoor fan and an engine cooling water pump, each of which is driven by the generation power of a generator, and after a lapse of a first predetermined time from a predetermined actuation time of an engine, the output power from the generator is output-controlled, and the power output control is started so as to obtain the generation power, and when it is determined that the generation voltage after the start of the power output control is equal to or higher than a predetermined voltage, the engine cooling water pump is driven, and after a lapse of a second predetermined time from a predetermined drive time of the engine cooling water pump, the outdoor fan is driven, and after a lapse of a third predetermined time from a predetermined drive time of the outdoor fan, the output control of the inverter is started.

2 Claims, 6 Drawing Sheets

(51) Int. Cl.
*F25B 27/00* (2006.01)
*F25B 13/00* (2006.01)
*F25B 49/00* (2006.01)

(52) U.S. Cl.
CPC ..... *F25B 2313/0294* (2013.01); *F25B 2313/02741* (2013.01); *F25B 2327/00* (2013.01); *F25B 2500/06* (2013.01); *F25B 2500/26* (2013.01); *F25B 2600/01* (2013.01); *F25B 2700/21154* (2013.01)

(58) Field of Classification Search
CPC ..... F25B 2313/0294; F25B 2327/00; F25B 2500/06; F25B 2500/26; F25B 2600/01; F25B 2700/21154; F25B 2327/01; F25B 2600/021
USPC ..... 62/323.1
See application file for complete search history.

(56) References Cited

U.S. PATENT DOCUMENTS 5,996,367 A * 12/1999 Harnish ..... F04B 35/002 417/295
6,155,062 A * 12/2000 Santarnecchi ..... B64D 13/08 62/158
8,069,827 B2 * 12/2011 Watanabe ..... B60K 6/48 123/41.02
2009/0043429 A1 * 2/2009 Minekawa ..... F01P 5/04 701/1
2010/0155036 A1 * 6/2010 Andris ..... F01P 7/164 165/104.31
2011/0214627 A1 * 9/2011 Nishikawa ..... F01P 7/04 123/41.02
2015/0075198 A1 3/2015 Amakawa et al.

* cited by examiner

ENGINE DRIVEN HEAT PUMP

CROSS REFERENCE TO RELATED APPLICATIONS

This application is related to co-pending applications: "ENGINE DRIVEN HEAT PUMP" filed even date herewith in the names of Kyoko Hashimoto, Shohei Amakawa and Masaya Horibe, which claims priority to Japanese Application No. 2013-272910 filed Dec. 27, 2013 and "ENGINE DRIVEN HEAT PUMP" filed even date herewith in the names of Hideshi Okada and Kyoko Hashimoto, which claims priority to Japanese Application No. 2013-272909 filed Dec. 27, 2013 each of the above-identified applications is assigned to the assignee of the present application and is incorporated by reference herein.

INCORPORATION BY REFERENCE REGARDING APPLICATION AND PRIORITY

This nonprovisional application claims priority under U.S.C. 119(a) on Patent Application No. 2013-272908 filed in Japan on Dec. 27, 2013, the entire contents of which are hereby incorporated by reference.

BACKGROUND OF THE INVENTION

Field of the Invention

The present invention relates to an engine driven heat pump in which heat exchange is performed by use of a refrigerant, which is sucked and discharged by a compressor driven by an engine, thereby flowing through a refrigerant circuit.

Description of the Related Art

Conventionally, it has been known that a generator is mounted in the engine driven heat pump in which heat exchange is performed by use of a refrigerant, which is sucked and discharged by a compressor driven by the engine, thereby flowing through a refrigerant circuit (see, for example, Japanese Patent No. 4682558).

Japanese Patent No. 4682558 discloses that the engine driven heat pump, in which the generator is mounted, is used as a power supply device at the time of power failure.

However, Japanese Patent No. 4682558 discloses that the engine driven heat pump, in which the generator is mounted, is used as the power supply device at the time of power failure, Japanese Patent No. 4682558 fails to disclose any specific timing of supplying power to an internal instrument that is provided in the engine driven heat pump and driven by the generation power of a generator, at the start time of a self-sustaining operation.

SUMMARY OF THE INVENTION

The present invention provides an engine driven heat pump, in which a generator is mounted, the engine driven heat pump configured to be used as a power supply device at the time of power failure and configured to provide operational constitution regarding a drive start timing, at the start time of a self-sustaining operation of an internal instrument that is provided in the engine driven heat pump and driven by the generation power of a generator.

According to one aspect of the present invention, an engine driven heat pump includes an engine, a compressor configured to be driven by the engine, a refrigerant circuit configured to flow a refrigerant sucked and discharged by the compressor, a generator configured to be driven by the engine, an outdoor fan and an engine cooling water pump, each of which is configured to be driven by generation power of the generator, an engine actuation battery configured to actuate the engine, a battery charging circuit configured to charge the engine actuation battery, and an inverter configured to convert output power from the generator into a predetermined voltage and a predetermined frequency, wherein after a lapse of a first predetermined time from a predetermined actuation time of the engine, the output power from the generator is output-controlled, and the power output control is started so as to obtain the generation power, and wherein when it is determined that the generation voltage after the start of the power output control is equal to or higher than a predetermined voltage, the engine cooling water pump is driven, and wherein after a lapse of a second predetermined time from a predetermined drive time of the engine cooling water pump, the outdoor fan is driven, and wherein after a lapse of a third predetermined, time from a predetermined drive time of the outdoor fan, output control of the inverter is started.

Herein, the predetermined actuation time of the engine, for example, can be provided as any time point in a period from the time point when the engine is actuated to a time point when the actuation is completed wherein the engine revolutions, which are the revolutions of the engine, correspond to predetermined actuation completion revolutions at which it can be determined that the actuation of the engine is completed. Also, the predetermined drive time of the engine cooling water pump, for example, can be provided as any time point in a period from a time point when the drive of the engine cooling water pump is indicated to a time point when it is determined that the rotation of the engine cooling water pump is started. Also, the predetermined drive time of the outdoor fan, for example, can be provided as any time point in a period from the time point when the drive of the outdoor fan is indicated to a time point when it is determined that the rotation of the outdoor fan is started.

According to another aspect of the present invention, a mode can be exemplified where the rated power consumption of the engine cooling water pump is lower than the rated power consumption of the outdoor fan.

According to another aspect of the present invention, a mode can be exemplified where, when the compressor is not operated, and the generator is driven, the upper-limit revolutions of the outdoor fan are reduced, compared with a case where the compressor is operated, and the generator is driven.

According to another aspect of the present invention, with respect to an engine driven heat pump that includes a generator and is used as a power supply device at the time of power failure, the engine driven heat pump can provide operational constitution regarding a timing of supplying power at the start time of a self-sustaining operation of an internal instrument that is provided in the engine driven heat pump and driven by the generation power of a generator.

DESCRIPTION OF THE PREFERRED EMBODIMENT

Hereinafter, the embodiment of the present invention will be described referring to drawings.

Figure 1:
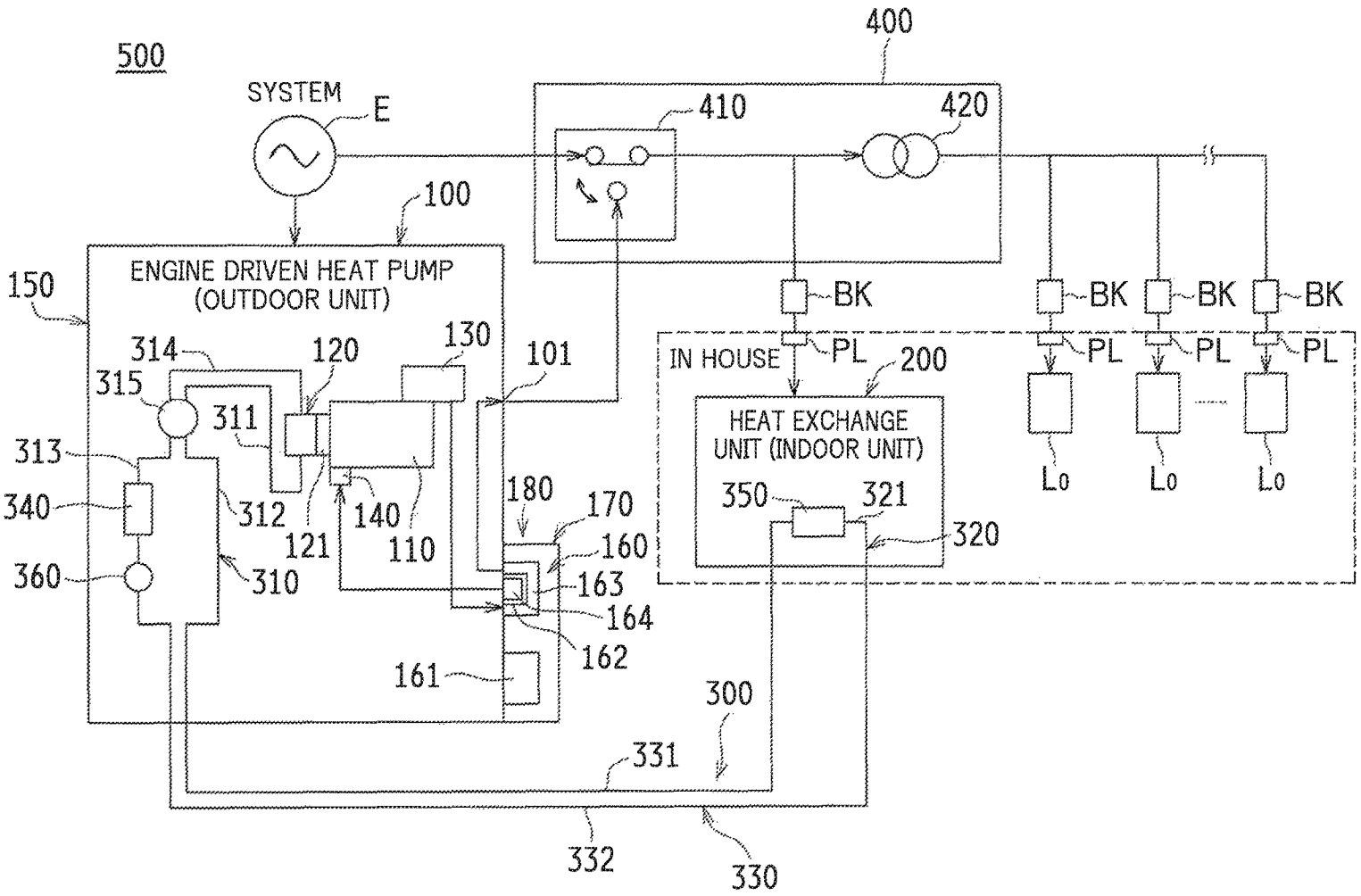
FIG. 1 is a schematic block diagram illustrating one example of a heat exchange system including an engine driven heat pump according to the embodiment of the present invention.

FIG. 1 is a schematic block diagram illustrating one example of a heat exchange system 500 including an engine driven heat pump 100 according to the embodiment of the present invention.

The heat exchange system 500 illustrated in FIG. 1 is provided in such a manner that a refrigerant is circulated through a refrigerant circulation path 300 while a state where the refrigerant is decompressed and brought down to a low temperature and a state where the refrigerant is pressurized and brought up to a high temperature are alternated by means of the engine driven heat pump 100.

The refrigerant circulation path 300 includes a first refrigerant circuit 310 (one example of a refrigerant circuit) provided in the engine driven heat pump 100 (an outdoor unit constituting an air conditioner in the example), a second refrigerant circuit 320 provided in a heat exchange unit 200 (an indoor unit constituting the air conditioner in the example), a third refrigerant circuit 330 with which the first refrigerant circuit 310 and the second refrigerant circuit 320 are communicated, a first heat exchanger 340 provided in the engine driven heat pump 100 and interposed in the first refrigerant circuit 310, a second heat exchanger 350 provided in the heat exchange unit 200 and interposed in the second refrigerant circuit 320, and an expansion valve 360 interposed in the refrigerant circuit (the first refrigerant circuit 310 in the example) provided between the first heat exchanger 340 and the second heat exchanger 350.

The first refrigerant circuit 310 of the engine driven heat pump 100 includes a discharge-side first refrigerant pipe 311 that is connected to a discharge side of a compressor 120 that is driven by an engine 110, thereby sucking and discharging the refrigerant, a one-side first refrigerant pipe 312 that is connected to one side of a third refrigerant pipe 331 on the one side of the third refrigerant circuit 330, an other-side first refrigerant pipe 313 that is connected to a third refrigerant pipe 332 on the other side of the third refrigerant circuit 330, an suction-side first refrigerant pipe 314 that is connected to the suction side of the compressor 120, and a four-way valve 315. The four-way valve 315 is connected to the discharge-side first refrigerant pipe 311, the one-side first refrigerant pipe 312, the other-side first refrigerant pipe 313, and the suction-side first refrigerant pipe 314, and the four-way valve 315 is switchable in such a manner that the refrigerant from the discharge-side first refrigerant pipe 311 is guided to the one-side first refrigerant pipe 312, and the refrigerant from the other-side first refrigerant pipe 313 is guided to the suction-side first refrigerant pipe 314, or in such a manner that the refrigerant from the discharge-side first refrigerant pipe 311 is guided to the other-side first refrigerant pipe 313, and the refrigerant from the one-side first refrigerant pipe 312 is guided to the suction-side first refrigerant pipe 314. The first heat exchanger 340 is provided in the other-side first refrigerant pipe 313, and the expansion valve 360 is provided between the first heat exchanger 340 and the third refrigerant pipe 332 on the other side of the third refrigerant circuit 330 with respect to the other-side first refrigerant pipe 313. The second refrigerant circuit 320 of the heat exchange unit 200 includes a second refrigerant pipe 321 connected to the third refrigerant pipe 331 on the one side of the third refrigerant circuit 330 and the third refrigerant pipe 332 on the other side of the third refrigerant circuit 330. The second heat exchanger 350 is provided in the second refrigerant pipe 321.

With the above-mentioned constitution, when the heat exchange system 500 is utilized for heating or hot-water supply (heating in the example), the four-way valve 315 is switched in such a manner that the refrigerant from the discharge-side first refrigerant pipe 311 is guided to the one-side first refrigerant pipe 312, and the refrigerant from the other-side first refrigerant pipe 313 is guided to the suction-side first refrigerant pipe 314, and the low-temperature refrigerant is brought into indirect contact with the open air or water via the first heat exchanger 340 so as to absorb heat, and further the refrigerant is compressed by the compressor 120 and brought up to a high temperature, and air in a room or water for hot-water supply (air in a room in the example) is heated via the second heat exchanger 350. In contrast, when the heat exchange system 500 is utilized for air conditioning or cold storage (air conditioning in the example), the four-way valve 315 is switched in such a manner that the refrigerant from the discharge-side first refrigerant pipe 311 is guided to the other-side first refrigerant pipe 313, and the refrigerant from the one-side first refrigerant pipe 312 is guided to the suction-side first refrigerant pipe 314, and the high-temperature refrigerant is brought into indirect contact with the open air and the like via the first heat exchanger 340 so as to discharge heat, and further the refrigerant is decompressed through the expansion valve 360 and brought down to a low temperature, and the air in the room or a refrigerator (the room in the example) is cooled via the second heat exchanger 350.

Also, regarding the heat exchange system 500, the engine driven heat pump 100, in which a generator 130 that outputs the output power based on the rotational drive of the engine 110 is mounted, is used as a power supply device at the time of power failure of a system E (specifically, commercial power supply), and the heat exchange system 500 further includes a self-sustaining switching device 400 that switches a system operation and a self-sustaining operation, which is performed at the time of power failure of the system E.

The self-sustaining switching device 400 includes a switching unit 410 that switches operations on whether the system E and wiring attachment connectors PL such as an attachment plug or a wall socket in a house are connected via wiring circuit breakers BK (breaker) or whether an independent output unit 101 of the engine driven heat pump 100 and the wiring attachment connectors PL in the house are connected via the wiring circuit breakers BK.

In the present embodiment, the switching unit 410 automatically switches from/to a system connection state where the system E and the wiring attachment connectors PL are connected when the system power is supplied from the system E to/from a power-failure connection state where the independent output unit 101 of the engine driven heat pump 100 and the wiring attachment connectors PL are connected when the power supply is cut off. It is noted that the switching unit 410 may switch the system connection state and the power-failure connection state in a manual manner.

Also, the self-sustaining switching device 400 further includes a transformer 420. The transformer 420 transforms 200V system voltage to 100V system voltage. The transformer 420 is provided on a connecting line between the wiring circuit breaker BK corresponding to the wiring attachment connector PL for the 200V system (connector connected to the heat exchange unit 200 in the example) and the wiring circuit breaker BK corresponding to the wiring attachment connector PL for the 100V system (in the example, a connector connected to a general load Lo such as an illuminator or a television set that is usually used).

In the present embodiment, regarding the engine driven heat pump 100, a main body package 150 stores the engine 110 (a gas engine in the example), the compressor 120 driven by the engine 110, the first refrigerant circuit 310 that flows the refrigerant sucked and discharged by the compressor 120, and the generator 130 driven by the engine 110. Specifically, a driving force from the engine 110 is transmitted to the compressor 120 via an electromagnetic clutch 121. The driving force from the engine 110 is transmitted to the generator 130 directly or indirectly via a driving transmission means not illustrated. It is noted that the engine 110 is provided as a gas engine, but not limited thereto. Engines except for the gas engine may be applied.

The engine driven heat pump 100 includes a self-sustaining power supply device 160 that includes an engine actuation battery 161 that supplies power to an engine starter 140 (specifically, a starter motor) for starting the engine 110 and actuates the engine 110, a battery charging circuit 162 (specifically, a battery charger) that charges the engine actuation battery 161, and an inverter 163 (specifically, a self-sustaining inverter) that converts the output power from the generator 130 into a predetermined voltage and a predetermined frequency. In the present embodiment, the self-sustaining power supply device 160 further includes a starter relay 164. The starter relay 164 is connected between the engine starter 140 and the engine actuation battery 161 and configured to supply battery power from the engine actuation battery 161 to the engine starter 140.

It is noted that the inverter 163 can switch two frequencies that are different from each other (specifically, 50 Hz or 60 Hz). Regarding the engine driven heat pump 100, the self-sustaining power supply device 160 is stored in a separate body package 170 that is separate from the main body package 150. A battery unit 180 is constituted by the self-sustaining power supply device 160 and the separate body package 170.

<Electric Circuit in Engine Driven Heat Pump>

Next, the electric circuit of the engine driven heat pump 100 according to the present embodiment will be described.

Figure 2:
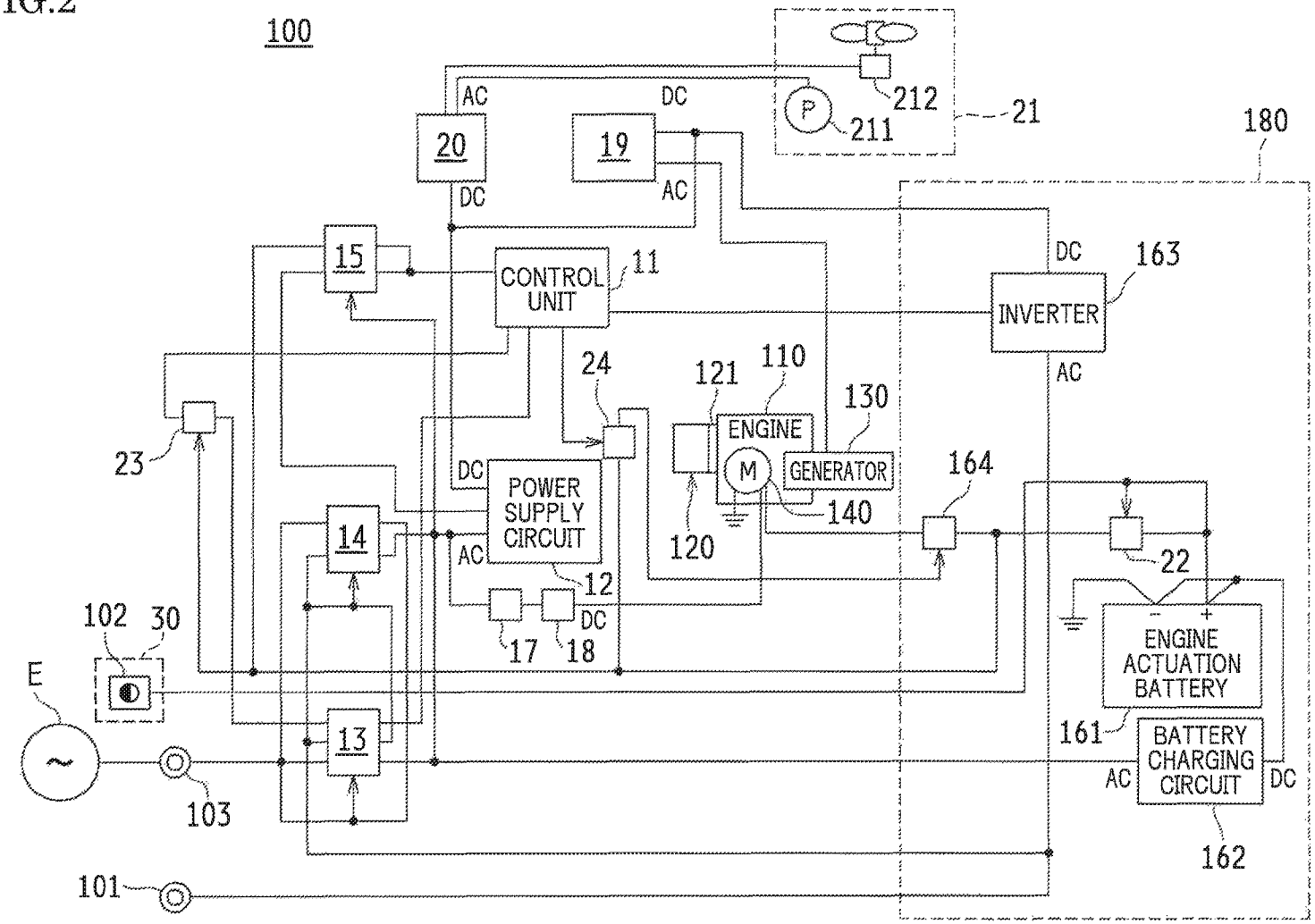
FIG. 2 is a block diagram illustrating the schematic constitution of the electric circuit of the engine driven heat pump according to the present embodiment.

FIG. 2 is a block diagram illustrating the schematic constitution of the electric circuit of the engine driven heat pump 100 according to the present embodiment.

As illustrated in FIG. 2, the engine driven heat pump 100 includes a control unit 11, a power supply circuit 12, a system cutoff relay 13, an independent power supply relay 14, and a self-sustaining switch 102, in addition to the engine 110, the compressor 120, the generator 130, the engine actuation battery 161, the battery charging circuit 162, the inverter 163, the starter relay 164, the engine starter 140, and the independent output unit 101, each of which is described above.

The control unit 11 gains the whole control of the engine driven heat pump 100 and constitutes a control board. The control unit 11 includes a processing unit (not illustrated) such as a Central Processing Unit (CPU) and a storage unit (not illustrated) that includes a nonvolatile memory such as Read Only Memory (ROM), a rewritable nonvolatile memory such as a flash memory, and a volatile memory such as Random Access Memory (RAM). The control unit 11 includes a timer function of measuring a time. In the engine driven heat pump 100, the processing unit of the control unit 11 loads a control program stored in advance in the ROM of the storage unit on the RAM of the storage unit and executes the control program, thereby controlling various constitutional elements. Also, various system information such as the operational parameters and setting data of the engine driven heat pump 100 is stored in the nonvolatile memory of the storage unit.

Then, the control unit 11 is configured to switch between an ordinary operational mode for driving the engine 110 in a case where a user's request (a user's instruction) for a heat pump operation (air conditioning in the example) is provided and a self-sustaining mode for driving the engine 110 irrespective of the request for the heat pump operation (air conditioning in the example).

The power supply circuit 12 supplies power to electric instruments (in the example, the control unit 11 and an ignition plug, not illustrated, of the engine 110) in the engine driven heat pump 100 and constitutes a power supply board. The power supply circuit 12 converts the input power of an alternating current into the output power of a direct current and serves as a power supply for the control unit 11 or as a power supply for the ignition plug of the engine 110 in the example.

The system cutoff relay 13 is configured to self-hold a closed state based on the power of the system E, connect to the system E, the power supply circuit 12, and the battery charging circuit 162, and supply the system power from the system E to the power supply circuit 12 and the battery charging circuit 162, whereas the system cutoff relay 13 is configured to fall into an open state at the time of power failure and cut off the connection between the system E, and the power supply circuit 12 and the battery charging circuit 162.

When the independent power supply relay 14 is connected in parallel with the system cutoff relay 13 with respect to the power supply circuit 12 and the battery charging circuit 162, and when the power from the system E is supplied, the independent power supply relay 14 is configured to fall into an open state and cut off the connection between the system cutoff relay 13, and the power supply circuit 12 and the battery charging circuit 162, whereas the independent power supply relay 14 is configured to self-hold a closed state based on the output power from the inverter 163 at the time of power failure, connect the inverter 163 with the power supply circuit 12 and the battery charging circuit 162, and supply the output power from the inverter 163 to the power supply circuit 12 and the battery charging circuit 162.

The self-sustaining switch 102 is configured to maintain an ON state based on a user's ON operation, whereas the self-sustaining switch 102 is configured to be turned off from the ON state based on the user's OFF operation and maintain an OFF state. More particularly, the self-sustaining switch 102 includes functions of manually switching the connection or cutoff between the engine actuation battery 161 and the control unit 11 only during the power failure and manually switching ON/OFF (presence and absence) of a self-sustaining signal that instructs the control unit 11 to perform a self-sustaining operation. It is noted that the self-sustaining switch 102 can be operated from a control panel 30 in a house.

In the present embodiment, the engine driven heat pump 100 further includes an input power supply relay 15.

The input power supply relay 15 is configured to supply the output power from the power supply circuit 12 to the control unit 11, whereas when the self-sustaining switch 102 is turned on at the time of power failure, the input power supply relay 15 is configured to supply the battery power from the engine actuation battery 161 to the control unit 11.

It is noted that members that are not described in FIG. 2 will be described in specific circuit constitution below.

<Regarding Specific Circuit Constitution>

Next, the specific circuit constitution of the engine driven heat pump 100 according to the present embodiment will be described referring to FIG. 3.

Figure 3:
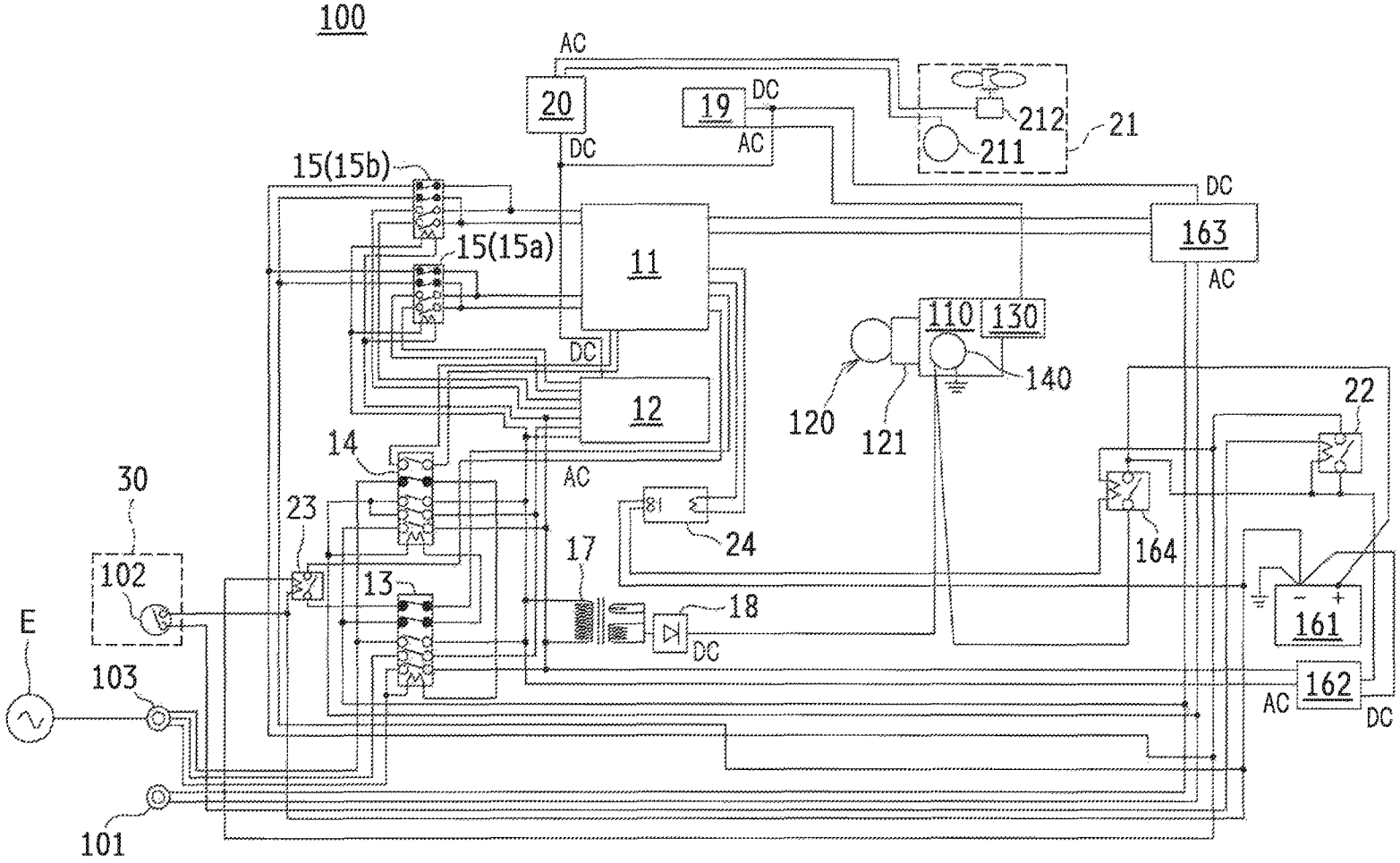
FIG. 3 is a detailed diagram of the electric circuit in the engine driven heat pump according to the present embodiment.

FIG. 3 is a detailed diagram of an electric circuit in the engine driven heat pump 100 according to the present embodiment.

(Circuit Constitution Regarding Circuit Operation when System Power is Supplied)

The system cutoff relay 13 includes an A contact point (○ illustrated in FIG. 3) at which the system cutoff relay 13 is conducted (closed) in an excited state where an exciting coil is excited and non-conducted (opened) in a non-excited state where the exciting coil is not excited and a B contact point (● illustrated in FIG. 3) at which the system cutoff relay 13 is non-conducted (opened) in the excited state and conducted (closed) in the non-excited state. Herein, the meaning of the A contact point or the B contact point is similarly applied to the independent power supply relay 14, the input power supply relay 15 (specifically, a control power supply relay 15*a* and an ignition power supply relay 15*b*), a battery relay 22 described later, a self-sustaining input relay 23, a starter relay 164, and a control relay 24.

The system cutoff relay 13 includes three A contact points (○) and two B contact points (●), and the independent power supply relay 14 includes four A contact points (○) and one B contact point (●). The input power supply relay 15 is constituted by the control power supply relay 15*a* and the ignition power supply relay 15*b*. The input power supply relay 15 (specifically, the control power supply relay 15*a* and the ignition power supply relay 15*b*) includes two A contact points (○) and two B contact points (●).

The engine driven heat pump 100 further includes a system input unit 103 connected to the system E, a starting transformer 17 that steps down the system voltage of the system E, a rectifier circuit 18 (specifically, a rectifier) that converts alternating current power from the starting transformer 17 into direct current power, a generator controller 19 that output-controls the output power (alternating current power) from the generator 130 and gains generation power (direct current power) required for power generation, and an internal instrument 21 (internal electric instrument) that includes an engine cooling water pump 211 and an outdoor fan 212 that are driven based on the generation power from the generator controller 19 via an internal instrument power converter 20. The internal instrument power converter 20 supplies the drive power (alternating current power), which is gained by converting the generation power (direct current power) from the generator controller 19, to the internal instrument 21 that includes the engine cooling water pump 211 and the outdoor fan 212. Herein, the generator controller 19 acts as a direct current stabilized power supply that output-controls the output voltage (alternating current voltage) from the generator 130 in such a manner that the output voltage from the generator 130 is held at a constant generation voltage (direct current voltage). The internal instrument power converter 20 acts as an internal instrument inverter that converts the generation power (direct current power) from the generator controller 19 into the drive power (alternating current power). The engine cooling water pump 211 circulates the coolant that cools the engine 110. Also, the outdoor fan 212 discharges air from the inside to the outside of the device and includes a function of flowing the coolant that cools the engine 110 at the start of the engine, in addition to a function of ventilating the first heat exchanger 340 during the heat pump operation (air conditioning in the example).

The system input unit 103 constitutes an external input terminal and inputs the system power from the system E.

The system input unit 103 is connected to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via the three A contact points (○) of the system cutoff relay 13. Also, the system input unit 103 is connected to the exciting coil of the system cutoff relay 13 via one B contact point (●) of the independent power supply relay 14.

The output side of the starting transformer 17 is connected to the engine starter 140 via the rectifier circuit 18.

The power supply input port (specifically, a control power supply port and an ignition power supply port) of the control unit 11 is connected to the direct current side of the power supply circuit 12 via the two A contact points (○) of the input power supply relay 15 (specifically, the control power supply relay 15*a* and the ignition power supply relay 15*b*).

Also, the direct current side of the power supply circuit 12 and the direct current side of the generator controller 19 are connected to the internal instrument 21 via the internal instrument power converter 20. The alternating current side of the generator controller 19 is connected to the generator 130.

Furthermore, the output side of the battery charging circuit 162 is connected to the engine actuation battery 161.

It is noted that, although not illustrated, an earth leakage breaker (ELB: Earth Leakage circuit Breaker) is connected between the system input unit 103, and the system cutoff relay 13 and the independent power supply relay 14. A starter relay whose operation is controlled by the control unit 11 is connected between the rectifier circuit 18 and the engine starter 140. A power-failure capacitor is connected in the middle of the line between the two A contact points (○) disposed between the control power supply relay 15*a* and the control power supply port of the control unit 11. A generator reactor is connected between the generator 130 and the input side of the generator controller 19.

(Circuit Constitution Regarding Circuit Operation when System Power is Cut Off)

The engine driven heat pump 100 further includes the battery relay 22, the self-sustaining input relay 23, and the control relay 24.

The battery relay 22 is configured to cut off the connection between the engine actuation battery 161 and the exciting coil of the self-sustaining input relay 23, whereas when the self-sustaining switch 102 is turned on by a user, the battery relay 22 is configured to supply the battery power from the engine actuation battery 161 to the exciting coil of the self-sustaining input relay 23.

The self-sustaining input relay 23 is configured to cut off the conduction of the self-sustaining instruction port of the control unit 11, whereas when the battery power from the engine actuation battery 161 is supplied to the exciting coil via the battery relay 22, the self-sustaining input relay 23 is configured to bring the self-sustaining instruction port of the control unit 11 into conduction. Herein, when the self-sustaining instruction port is conducted, and the control unit 11 receives a self-sustaining signal, the control unit 11 can recognize that the self-sustaining switch 102 is turned on by the user, and that the self-sustaining operation is instructed, whereby the control unit 11 can switch operational modes to a self-sustaining mode.

The control relay 24 is configured to cut off the connection between the engine actuation battery 161 and the exciting coil of the starter relay 164, whereas when engine starting power from the control unit 11 is supplied to the exciting coil, the control relay 24 is configured to supply the battery power from the engine actuation battery 161 to the exciting coil of the starter relay 164.

The starter relay 164 is configured to cut off the connection between the engine actuation battery 161 and the engine starter 140, whereas when the battery power from the engine actuation battery 161 is supplied to the exciting coil via the control relay 24, the starter relay 164 is configured to supply the battery power from the engine actuation battery 161 to the engine starter 140.

Specifically, any of the battery relay 22, the self-sustaining input relay 23, the control relay 24, and the starter relay 164 includes one A contact point (○).

The exciting coil of the battery relay 22 is connected to the engine actuation battery 161 via the self-sustaining switch 102.

The exciting coil of the self-sustaining input relay 23 is connected to the engine actuation battery 161 via the A contact point (○) of the battery relay 22. The self-sustaining instruction port of the control unit 11 is connected via the A contact point (○) of the self-sustaining input relay 23 and one B contact point (●) of the system cutoff relay 13 and constitutes a closed circuit of the self-sustaining signal.

The exciting coil of the control relay 24 is connected to the engine starting output port of the control unit 11.

The exciting coil of the starter relay 164 is connected to the engine actuation battery 161 via the A contact point (○) of the control relay 24 and the A contact point (○) of the battery relay 22. The engine starter 140 is connected to the engine actuation battery 161 via the A contact point (○) of the starter relay 164.

The power supply input port (specifically, the control power supply port and the ignition power supply port) of the control unit 11 is connected to the engine actuation battery 161 via the two B contact points (●) of the input power supply relay 15 (specifically, the control power supply relay 15*a* and the ignition power supply relay 15*b*) and the A contact point (○) of the battery relay 22.

The signal input side of the inverter 163 is connected to the inverter output instruction port of the control unit 11.

Furthermore, the direct current side of the generator controller 19 is connected to the input side (direct current side) of the inverter 163.

Herein, although not illustrated, a fuse is connected between the A contact point (○) of the starter relay 164 and the exciting coil of the battery relay 22, and between the B contact point (●) of the input power supply relay 15 (specifically, the control power supply relay 15*a* and the ignition power supply relay 15*b*) and the A contact point (○) of the battery relay 22. The fuse and a battery switch are connected in series between the self-sustaining switch 102 and the exciting coil of the battery relay 22. The fuse and an independent actuation display lamp, which are disposed in parallel to the self-sustaining input relay 23, are connected in series between the terminals of the exciting coil of the self-sustaining input relay 23.

It is noted that other circuit constitution with regard to the circuit constitution regarding circuit operations at the time of power failure has been described. Accordingly, its description is omitted.

(Circuit Constitution Regarding Circuit Operation in Self-Sustaining Operation)

When the output power from the inverter 163 is received after the establishment of the voltage of the generator 130, the engine driven heat pump 100 is configured to supply the output power from the inverter 163 to the power supply circuit 12 and the battery charging circuit 162 by means of the independent power supply relay 14 and supply the output power from the inverter 163 to the outside of the engine driven heat pump 100 via the independent output unit 101.

Also, while the output power from the inverter 163 is being supplied, the engine driven heat pump 100 is configured to maintain the cutoff of the connection between the system E, and the power supply circuit 12 and the battery charging circuit 162 by means of the system cutoff relay 13 and maintain the output power from the inverter 163 until the self-sustaining signal is interrupted.

Also, when the power is restored, and the output power from the inverter 163 is interrupted, the engine driven heat pump 100 is configured to restore the connection between the system E, and the power supply circuit 12 and the battery charging circuit 162 by means of the system cutoff relay 13.

In the present embodiment, when the output power from the inverter 163 is interrupted, the engine driven heat pump 100 is configured to cut off the connection between the inverter 163, and the power supply circuit 12 and the battery charging circuit 162 by means of the independent power supply relay 14.

More particularly, the independent output unit 101 is connected in parallel to the independent power supply relay 14 with respect to the inverter 163 and constitutes external output terminals. The independent output unit 101 is connected to the switching unit 410 illustrated in FIG. 1 and configured to supply the output power from the inverter 163 to the switching unit 410.

When the output power from the inverter 163 is supplied to the exciting coil, the independent power supply relay 14 is configured to supply the output power from the inverter 163 to the power supply circuit 12 and the battery charging circuit 162, and the inverter output confirmation port of the control unit 11 is conducted. Herein, when the inverter output confirmation port is conducted, and the inverter output signal is received, the control unit 11 can recognize that the output power from the inverter 163 is outputted.

Specifically, the output side (alternating current side) of the inverter 163 is connected to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via three A contact points (○) of the independent power supply relay 14. Also, the output side of the inverter 163 is connected to the independent output unit 101. Furthermore, the output side of the inverter 163 is connected to the exciting coil of the independent power supply relay 14 via one B contact point (●) of the system cutoff relay 13. Herein, as described above, the system input unit 103 is connected to the exciting coil of the system cutoff relay 13 via the B contact point (●) of the independent power supply relay 14, and the output side of the inverter 163 is connected to the exciting coil of the independent power supply relay 14 via the B contact point (●) of the system cutoff relay 13. Accordingly, a circuit constituted between the system cutoff relay 13 and the independent power supply relay 14, which are connected in an above-mentioned manner, constitutes a circuit (so-called an interlock circuit) in which, with respect to the system cutoff relay 13 and the independent power supply relay 14, priority is placed on a one-side relay that operates first (excitation), and the operation (excitation) of the other-side relay is prohibited.

Also, the inverter output confirmation port of the control unit 11 is connected via one A contact point (○) of the independent power supply relay 14, thereby constituting the closed circuit of the inverter output signal.

Herein, although not illustrated, a cross current prevention transformer is connected between the independent power supply relay 14 and a branch portion on the independent power supply relay 14 side of the output side of the inverter 163, and a circuit protector (CP: Circuit Protector) is provided between the independent output unit 101 and a branch portion on the independent output unit 101 side of the output side of the inverter 163.

It is noted that other circuit constitution with regard to the circuit constitution regarding circuit operations at the time of the self-sustaining operation has been described. Accordingly, its description is omitted.

Figure 4:
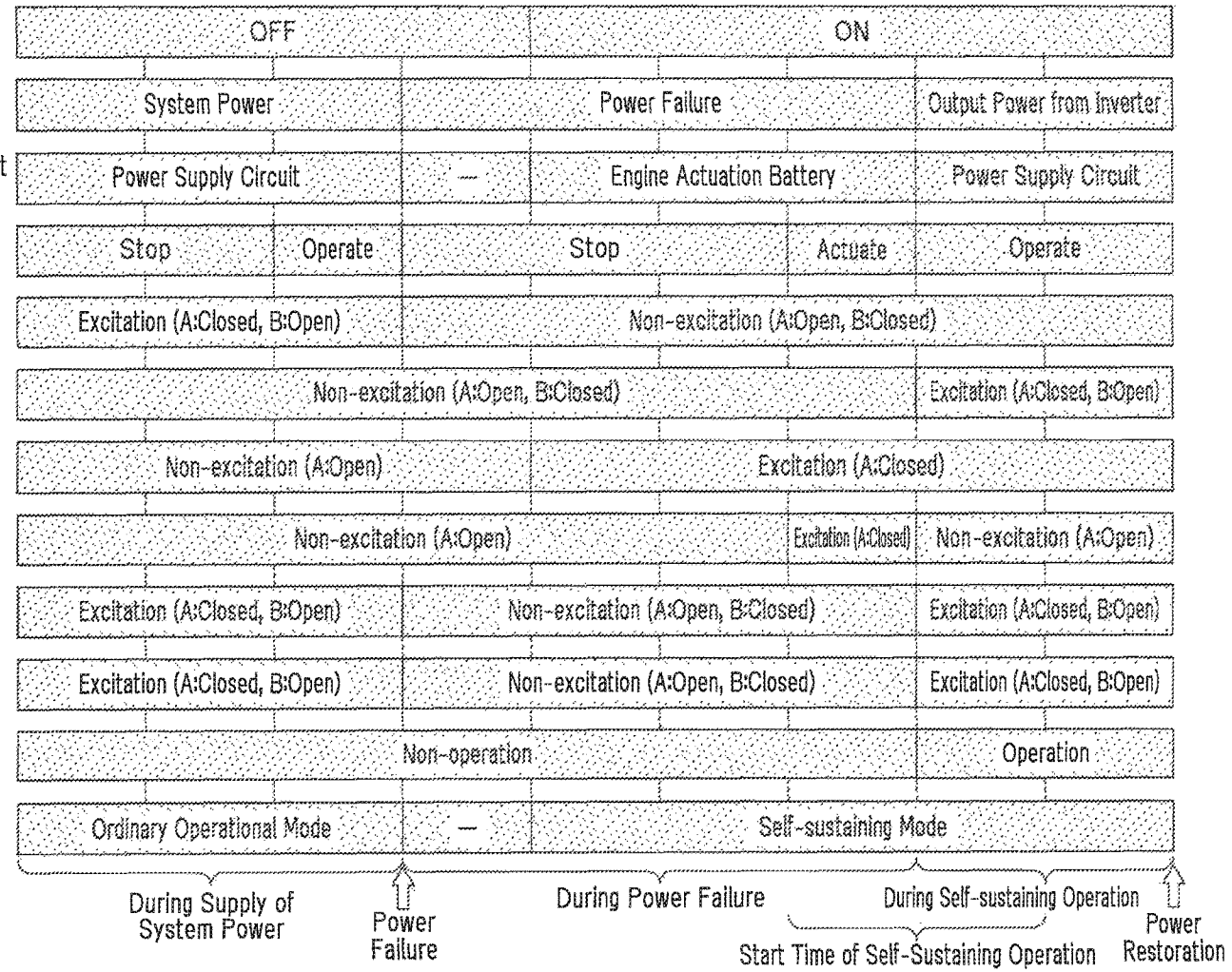
FIG. 4 is a timing chart illustrating the specific circuit operation of the engine driven heat pump according to the present embodiment.

FIG. 4 is a timing chart illustrating the specific circuit operation of the engine driven heat pump 100 according to the present embodiment.

In the engine driven heat pump 100 described above, at the time of the system power supply, the power failure, and the self-sustaining operation, the operational mode is represented as operational states illustrated in FIG. 4, regarding the self-sustaining switch 102, the supply of alternating current power, the supply of direct current power, the engine 110, the system cutoff relay 13, the independent power supply relay 14, the battery relay 22, the starter relay 164, the control power supply relay 15*a*, the ignition power supply relay 15*b*, the inverter 163, and the control unit 11.

Herein, the circuit operations of the engine driven heat pump 100 at the time of power failure and the self-sustaining operation will be described below, and the circuit operations of the engine driven heat pump 100 at the time of the system power supply and the like will be omitted. It is noted that the specification regarding Japanese Patent Application No. 2013-193237, which has been filed by the applicant, discloses the circuit operations of the engine driven heat pump 100 at the time of the system power supply.

(Circuit Operations of Engine Driven Heat Pump at Time of Power Failure)

Regarding the engine driven heat pump 100, when the self-sustaining switch 102 is turned on by the user from a state where the power of the system E is cut off, the battery power from the engine actuation battery 161 is supplied to the exciting coil of the battery relay 22, and the A contact point (○) of the battery relay 22 is conducted. Subsequently, regarding the engine driven heat pump 100, the battery power from the engine actuation battery 161 is supplied to the power supply input port (specifically, the control power supply port and the ignition power supply port) of the control unit 11 via the A contact point (○), which is in a conductive state with respect to the battery relay 22, and the B contact point (●), which is in a conductive state with respect to the input power supply relay 15 (specifically, the control power supply relay 15*a* and the ignition power supply relay 15*b*), and furthermore supplied to the exciting coil of the self-sustaining input relay 23 via the A contact point (○), which is in a conductive state with respect to the battery relay 22, and the A contact point (○) of the self-sustaining input relay 23 is conducted.

Accordingly, the battery power from the engine actuation battery 161 is supplied to the control unit 11, and the self-sustaining instruction port of the control unit 11 is conducted via the A contact point (○), which is in a conductive state with respect to the self-sustaining input relay 23, so that the control unit 11 can receive the self-sustaining signal. Consequently, the control unit 11 enters the operational state and further can recognize that the self-sustaining switch 102 is turned on by the user and the self-sustaining operation is instructed.

Then, when the control unit 11 recognizes that the self-sustaining operation is instructed by the user, the control unit 11 switches the operational mode to the self-sustaining mode, the engine starting power is supplied from the engine starting output port to the exciting coil of the control relay 24 for a predetermined period of time, irrespective of the user's request for the heat pump operation (air conditioning in the example) (specifically, the transmission for a predetermined period of time (for example, five seconds) is repeated at predetermined times at predetermined intervals (for example, for every three seconds)), and the battery power from the engine actuation battery 161 is supplied to the exciting coil of the starter relay 164 via the A contact point (○) of the control relay 24. Accordingly, the A contact point (○) of the starter relay 164 is conducted for a predetermined period of time, and the battery power from the engine actuation battery 161 is supplied to the engine starter 140 via the A contact point (○) of the starter relay 164, thereby starting the engine 110 and starting the generator 130.

Also, regarding the engine driven heat pump 100, the output power from the generator 130 is supplied to the input side of the inverter 163 via the generator controller 19, and the output power from the generator 130 is supplied to the internal instrument 21 via the generator controller 19 and the internal instrument power converter 20. Herein, in the engine driven heat pump 100, when the generator controller 19 is operated, and the generation power is outputted from the generator controller 19, the generation power from the generator controller 19 is supplied to the internal instrument power converter 20.

(Circuit Operations of Engine Driven Heat Pump at Time of Self-sustaining Operation)

Regarding the engine driven heat pump 100, in a state of the circuit operation at which the generator 130 is actuated, when the control unit 11 transmits the output instruction signal from the inverter output instruction port to the signal input side of the inverter 163 after the establishment of the voltage of the generator 130 (When the voltage reaches a predetermined voltage or higher, or after a predetermined period of time has passed), and the inverter 163 is actuated, the output power from the inverter 163 is supplied to the exciting coil of the independent power supply relay 14 via the B contact point (●), which is in a conductive state with respect to the system cutoff relay 13, and the A contact point (○) of the independent power supply relay 14 is conducted, while the B contact point (●) of the independent power supply relay 14 is non-conducted. Accordingly, regarding the engine driven heat pump 100, the output power from the inverter 163 is supplied to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via the A contact point (○), which is in a conductive state with respect to the independent power supply relay 14, and the A contact point (○) of the input power supply relay 15 (specifically, the control power supply relay 15*a* and the ignition power supply relay 15*b*) is conducted, whereas the B contact point (●) of the input power supply relay 15 is non-conducted.

Accordingly, in place of the battery power from the engine actuation battery 161, the engine driven heat pump 100 can supply the output power from the inverter 163 to the power supply input port of the control unit 11 (specifically, the control power supply port and the ignition power supply port) via the power supply circuit 12 and the A contact points (○), which is in a conductive state with respect to the input power supply relay 15 (specifically, the control power supply relay 15*a* and the ignition power supply relay 15*b*). Also, the engine driven heat pump 100 can supply the output power from the inverter 163 to the rectifier circuit 18 via the starting transformer 17 and supply the output power from the inverter 163 to the engine actuation battery 161 via the battery charging circuit 162. Furthermore, the engine driven heat pump 100 can supply the output power from the inverter 163 to the outside of the engine driven heat pump 100 via the independent output unit 101 (in the example, the switching unit 410 of the self-sustaining switching device 400 (see FIG. 1)).

<Regarding Timing of Supplying Power to Internal Instrument>

Incidentally, when the engine driven heat pump 100 transfers from a power failure state to the self-sustaining operation, there is a case where the actuation of the output power from the generator 130 at the start time of the self-sustaining operation is destabilized due to the timing of supplying power to the internal instrument 21 at the start time of the self-sustaining operation.

Accordingly, in the engine driven heat pump 100 according to the present embodiment, the operational constitution regarding the timing of supplying power to the internal instrument 21 at the start time of the self-sustaining operation is provided as follows. Herein, the start time of the self-sustaining operation represents a period from a time when the engine 110 actuates (that is, the output power Pa is outputted from the generator 130) (see α1 in FIG. 6 described later) to a time when the inverter 163 starts operating.

Figure 5:
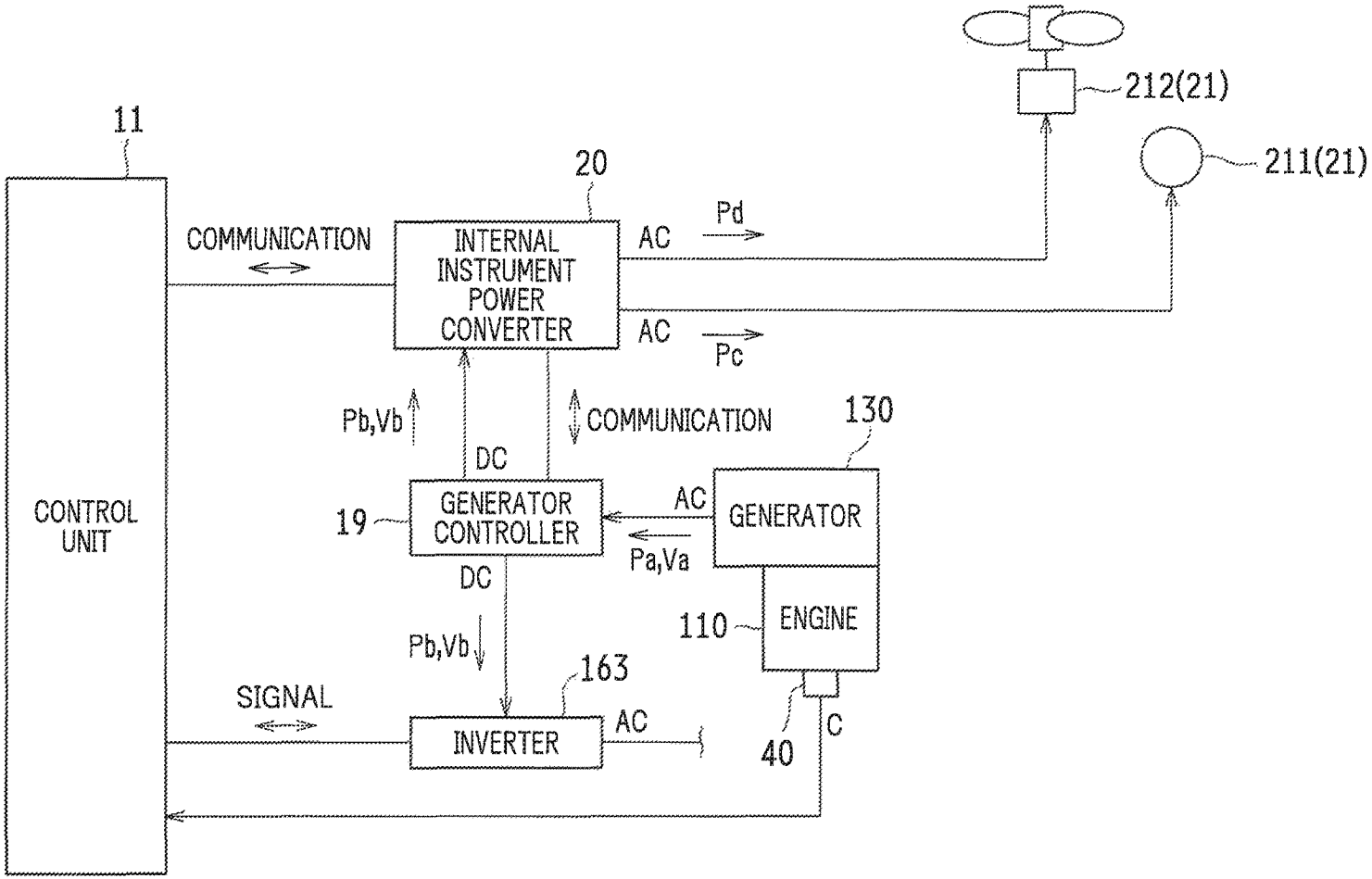
FIG. 5 is a system block diagram illustrating the control constitution of the engine driven heat pump according to the present embodiment.

FIG. 5 is a system block diagram illustrating the control constitution of the engine driven heat pump 100 according to the present embodiment. Also, FIG. 6 is a timing chart illustrating one example of control operations at the start time of the self-sustaining operation in the engine driven heat pump 100.

The engine driven heat pump 100 according to the present embodiment output-controls the output power Pa from the generator 130 after a lapse of a first predetermined time T1 (see FIG. 6) set in advance from a predetermined actuation time of the engine 110, which is set in advance, and the engine driven heat pump 100 starts the power output control so as to gain the generation power Pb. When it is determined that a generation voltage Vb after the start of the power output control is equal to or higher than a predetermined voltage Vb1 (see FIG. 6) set in advance, the engine driven heat pump 100 drives the engine cooling water pump 211, and after a lapse of a second predetermined time T2 (see FIG. 6) set in advance from a predetermined drive time of the engine cooling water pump 211, which is set in advance, the engine driven heat pump 100 drives the outdoor fan 212, and after a lapse of a third predetermined time T3 (see FIG. 6) set in advance from a predetermined drive time of the outdoor fan 212, which is set in advance, the engine driven heat pump 100 starts the output control of the inverter 163.

It is noted that the predetermined actuation time of the engine 110 may be a time point when the engine 110 is actuated, or a time point when the actuation of the engine 110 is completed, that is, a time point when engine revolutions C, which are the revolutions of the engine 110, correspond to predetermined actuation completion revolutions C2 set in advance, at which the actuation of the engine 110 is completed. Herein, the engine revolutions C mean the revolutions (revolution speed) per unit time of the engine 110. Also, the predetermined drive time of the engine cooling water pump 211 may be a time point when the control unit 11 indicates the drive of the engine cooling water pump 211 or a time point when the engine cooling water pump 211 is driven, and the control unit 11 recognizes the rotation of the engine cooling water pump 211. Also, the predetermined drive time of the outdoor fan 212 may be a time point when the control unit 11 indicates the drive of the outdoor fan 212 or a time point when the outdoor fan 212 is driven, and the control unit 11 recognizes the rotation of the outdoor fan 212.

Figure 6:
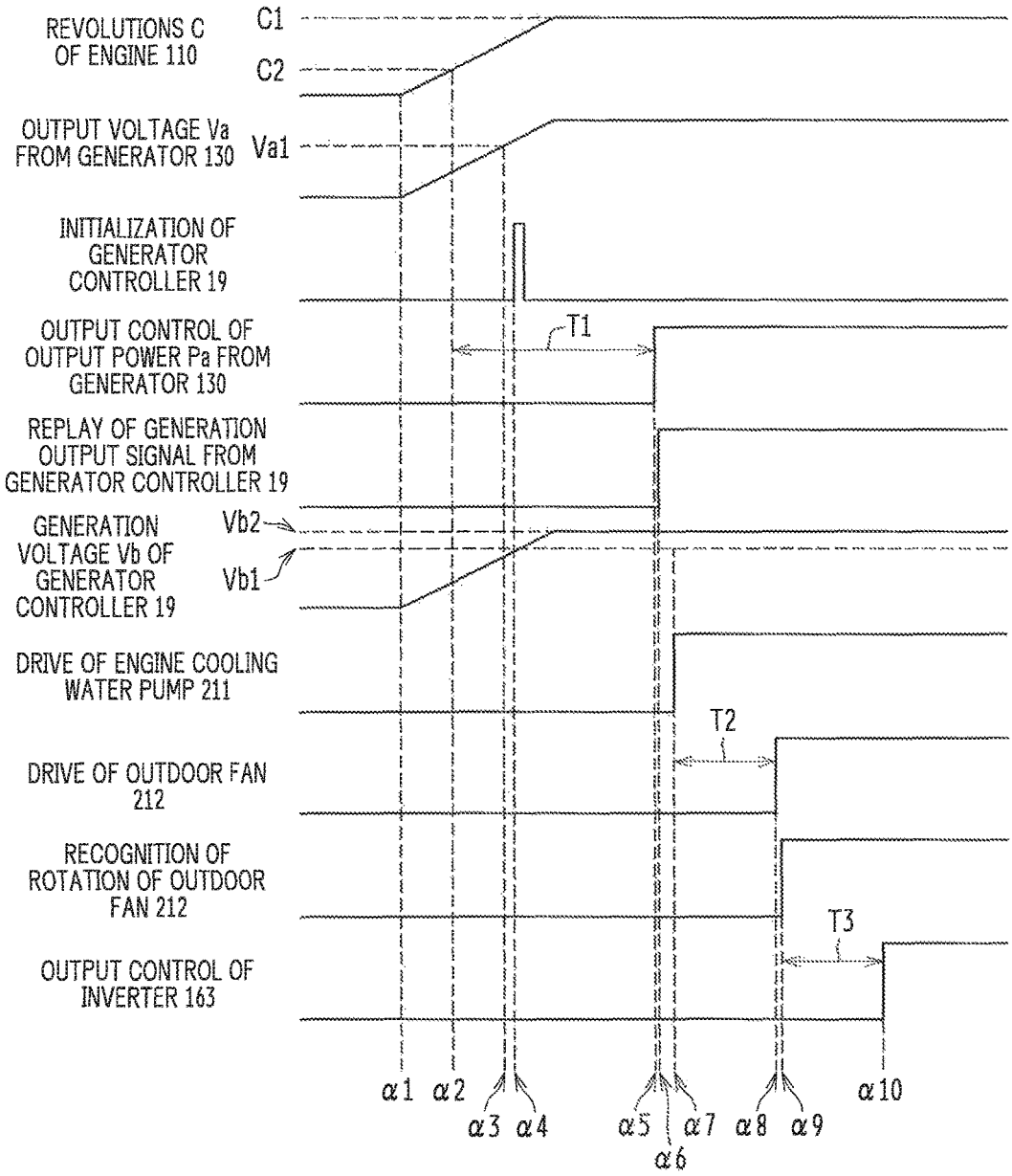
FIG. 6 is a timing chart illustrating one example of control operations at the start time of a self-sustaining operation in the engine driven heat pump.

In the example, after the lapse of the first predetermined time T1 (for example, 20 seconds) from the detection of the completion of the actuation of the engine 110 (see α2 in FIG. 6), the control unit 11 is configured to indicate the start of the power output control so as to perform the output control of the output power Pa from the generator 130 (see α5 in FIG. 6). After the indication of the start of the power output control (specifically, after the reply of a generation output signal indicating that the generation power Pb from the generator controller 19 is outputted (see α6 in FIG. 6)), when it is determined that the generation voltage Vb after the rectification of the output power Pa from the generator 130 is equal to or higher than the predetermined voltage Vb1 (for example, 300 V), the control unit 11 is configured to indicate the drive of the engine cooling water pump 211 (see α7 in FIG. 6). After the lapse of the second predetermined time T2 (for example, 10 seconds) from the indication of the drive of the engine cooling water pump 211, the control unit 11 is configured to indicate the drive of the outdoor fan 212 (see α8 in FIG. 6), and after the lapse of the third predetermined time T3 (for example, 10 seconds) from the start of the drive of the outdoor fan 212 (specifically, after the rotation of the outdoor fan 212 is recognized (see α9 in FIG. 6)), the control unit 11 is configured to indicate the start of the output control of the inverter 163 (see α10 in FIG. 6). In the present embodiment, a DC voltage (voltage that is not output-controlled), to which an output voltage Va (specifically, three-phase alternating current) is merely rectified, is generated in the generator controller 19 along with the drive of the generator 130 (see α1 in FIG. 6). It is noted that the control unit 11 may indicate the drive of the engine cooling water pump 211 when the predetermined number of revolutions or higher (for example, 1000 rpm: revolution per minute) is continuously held for a predetermined period of time (for example, 10 seconds) with respect to the engine revolutions C after the indication of the start of the power output control (specifically, after the reply (see α6 in FIG. 6) of the generation output signal indicating that the generation power Pb from the generator controller 19 is outputted), and when it is determined that the generation voltage Vb after the rectification of the output power Pa from the generator 130 is equal to or higher than the predetermined voltage Vb1 (for example, 300 V).

In the present embodiment, the control unit 11 is configured to be able to detect the start of the actuation of the engine 110 (see α1 in FIG. 6) and detect the completion of the actuation of the engine 110 (see α2 in FIG. 6).

More particularly, the engine driven heat pump 100 further includes a revolution detector 40 that detects the engine revolutions C (see FIG. 5). The revolution detector 40 is connected to the input system of the control unit 11. The revolution detector 40 detects the engine revolutions C, so that the control unit 11 is configured to control the engine 110 in such a manner that the engine revolutions C correspond to power generation revolutions C1 (for example, 2000 rpm), at which the generation power Pb by the generator 130 (specifically, the generation power Pb from the generator controller 19) can be supplied, at the time of power generation. It is noted that the control constitution of the engine revolutions C that are indicated from the control unit 11 to the engine 110 is similar to one conventionally known, and therefore its description will be omitted.

With the above-mentioned constitution, the rotation of the engine 110 is measured by means of the revolution detector 40, so that the control unit 11 can detect the start of the actuation of the engine 110 (see α1 in FIG. 6), and the predetermined actuation completion revolution C2 set in advance (for example, 800 rpm), at which the actuation of the engine 110 is completed, is measured, so that the control unit 11 can detect the completion of the actuation of the engine 110 (see α2 in FIG. 6).

In the present embodiment, when the engine revolutions C correspond to the smallest possible number of revolutions or higher, which is required to supply the predetermined power set in advance from the generator 130, and the output power Pa from the generator 130 is equal to or higher than the predetermined power, and the output voltage Va from the generator 130 is equal to or higher than a predetermined enabled voltage Va1 (see α3 in FIG. 6), the generator controller 19 falls into an enabled state where the generation power Pb can be outputted, thereby communicating with the control unit 11. Accordingly, the generator controller 19 performs the initialization, which is aimed at communicating with the control unit 11 (see α4 in FIG. 6). As a result, the control unit 11 recognizes that the generator controller 19 falls into the enabled state where the generation power Pb can be outputted.

The signal communication port of the generator controller 19 is connected to the signal communication port of the control unit 11 via the signal communication port of the internal instrument power converter 20 (see FIG. 5). The generator controller 19 transmits an enabled recognition signal, indicating that the generator controller 19 is in the enabled state, to the control unit 11. Accordingly, the control unit 11 can recognize whether or not the generator controller 19 is in the enabled state where the generation power Pb can be outputted (that is, whether or not the generator controller 19 can communicate with the control unit 11) based on the enabled recognition signal obtained from the generator controller 19 via the internal instrument power converter 20.

In the present embodiment, even when the generator controller 19 is in the enabled state where the generation power Pb can be outputted, the generator controller 19 does not perform the power output control with respect to the generation power Pb without the indication from the control unit 11. That is, the generator controller 19 outputs the generation power Pb, to which the power output control is performed, based on the indication from the control unit 11.

More particularly, after the lapse of the first predetermined time T1 (for example, 20 seconds) from the detection of the completion of the actuation of the engine 110 (see α2 in FIG. 6), the control unit 11 output-controls the output power Pa from the generator 130 by means of the generator controller 19 and indicates the start of the power output control so as to obtain the generation power Pb (see α5 in FIG. 6), thereby allowing the generator controller 19 to output the generation power Pb. In the example, the generator controller 19 converts the output voltage Va from the generator 130 into the generation voltage Vb based on the indication of the start of the power output control from the control unit 11 and maintains a predetermined direct-current voltage Vb2 (for example, 330 V). Herein, the first predetermined time T1, for example, can be defined as a sufficient time to the extent that the engine revolutions C correspond to the power generation revolutions C1, and that the generator controller 19 falls into the enabled state where the generation power Pb can be outputted.

In the present embodiment, after the control unit 11 indicates the start of the power output control (see α5 in FIG. 6) (specifically, after the reply (see α6 in FIG. 6) of the generation output signal indicating that the generation power Pb from the generator controller 19 is outputted), and when it is determined that the generation voltage Vb after the rectification of the output power Pa from the generator 130 by means of the generator controller 19 is equal to or higher than the predetermined voltage Vb1 (for example, 300 V), the control unit 11 indicates the drive of the engine cooling water pump 211 of the internal instrument 21 (see α7 in FIG. 6). Herein, the predetermined voltage Vb1, for example, can be defined as a voltage sufficient enough to drive the engine cooling water pump 211 (furthermore, the outdoor fan 212).

When the generator controller 19 outputs the generation power Pb, the generator controller 19 returns the generation output signal, indicating that the generation power Pb is outputted, to the control unit 11 (see α6 in FIG. 6). Then, the control unit 11 recognizes that the generator controller 19 has outputted the generation power Pb.

The signal communication port of the internal instrument power converter 20 is connected to the signal communication port of the control unit 11. The internal instrument power converter 20 measures the generation voltage Vb supplied from the generator controller 19 and transmits a generation voltage recognition signal, indicating the generation voltage Vb, to the control unit 11. Accordingly, the control unit 11 can detect the generation voltage Vb from the generator controller 19 based on the generation voltage recognition signal transmitted from the generator controller 19.

The control unit 11 communicates with the internal instrument power converter 20 and detects the generation voltage Vb supplied from the generator controller 19, so that the control unit 11 can determine the generation voltage Vb after the rectification of the output power Pa from the generator 130 by means of the generator controller 19. It may be such that the engine driven heat pump 100 further may include a generation voltage measuring instrument that is connected to the input system of the control unit 11 and measures the generation voltage Vb from the generator controller 19, and the control unit 11 measures the generation voltage Vb from the generator controller 19 by means of the generation voltage measuring instrument, whereby the generation voltage Vb after the rectification of the output power Pa from the generator 130 by means of the generator controller 19 may be determined.

The internal instrument power converter 20 can switch presence and absence of the supply of power to the engine cooling water pump 211 under the indication of the control unit 11. When the supply of the drive power is indicated by the control unit 11, the internal instrument power converter 20 is configured to supply cooling-water-pump drive power Pc to the engine cooling water pump 211, whereas when the stoppage of the supply of the drive power is indicated by the control unit 11, the internal instrument power converter 20 is configured to cut off the supply of the cooling-water-pump drive power Pc to the engine cooling water pump 211.

In the present embodiment, after the lapse of the second predetermined time T2 (for example, 10 seconds) from the indication of the drive of the engine cooling water pump 211 (see α7 in FIG. 6), the control unit 11 is configured to indicate the drive of the outdoor fan 212, which is the internal instrument 21 (see α8 in FIG. 6). Herein, for example, the second predetermined time T2 can be defined as a time sufficient enough to stabilize the generation power Pb from the generator controller 19 after the drive of the engine cooling water pump 211.

Also, the internal instrument power converter 20 can switch presence and absence of the supply of power to the outdoor fan 212 under the indication of the control unit 11. When the supply of the drive power is indicated by the control unit 11, the internal instrument power converter 20 is configured to supply outdoor-fan drive power Pd to the outdoor fan 212, whereas when the stoppage of the supply of the drive power is indicated by the control unit 11, the internal instrument power converter 20 is configured to cut off the supply of the outdoor-fan drive power Pd to the outdoor fan 212.

In the present embodiment, after the lapse of the third predetermined time T3 (for example, 10 seconds) from the start of the drive of the outdoor fan 212 (specifically, after the control unit 11 recognizes the rotation of the outdoor fan 212 (see α9 in FIG. 6)), the control unit 11 is configured to indicate the start of the output control of the inverter 163 (see α10 in FIG. 6). Herein, for example, the third predetermined time T3 can be defined as a time sufficient enough to stabilize the generation power Pb from the generator controller 19 after the drive of the outdoor fan 212. When a plurality of outdoor fans 212 are provided, the control unit 11 recognizes the rotation of at least one of the outdoor fans 212, and after a lapse of the third predetermined time T3, the control unit 11 can indicate the start of the output control of the inverter 163.

More particularly, the internal instrument power converter 20 includes functions of detecting the revolutions of the outdoor fan 212 and reporting the detected revolutions of the outdoor fan 212 to the control unit 11. Specifically, the internal instrument power converter 20 measures the revolutions of the outdoor fan 212 and transmits an outdoor-fan revolution recognition signal, indicating the revolutions of the outdoor fan 212, to the control unit 11. The control unit 11 is configured to be able to detect the revolutions of the outdoor fan 212 (that is, whether or not the outdoor fan 212 is driven and rotated) based on the outdoor-fan revolution recognition signal obtained from the internal instrument power converter 20. Accordingly, the control unit 11 can recognize that the outdoor fan 212 is driven and rotated (see α9 in FIG. 6). Herein, the revolutions of the outdoor fan 212 mean the revolutions (revolution speed) per unit time of the outdoor fan 212.

In the present embodiment, after the lapse of the second predetermined time T2 from the indication of the drive of the engine cooling water pump 211 (see α7 in FIG. 6), the control unit 11 is configured to indicate the drive of the outdoor fan 212 (see α8 in FIG. 6). However, it may be such that, after the lapse of the second predetermined time T2 from the start of the drive of the engine cooling water pump 211 (specifically, after the recognition of the rotation of the engine cooling water pump 211), the control unit 11 may be configured to indicate the drive of the outdoor fan 212 (see α8 in FIG. 6).

In this case, the engine driven heat pump 100 can be constituted in the following manner. That is, the internal instrument power converter 20 includes functions of detecting the revolutions of the engine cooling water pump 211 and reporting the detected revolutions of the engine cooling water pump 211 to the control unit 11. Specifically, the internal instrument power converter 20 measures the revolutions of the engine cooling water pump 211 and transmits a cooling-water-pump revolution recognition signal, indicating the revolutions of the engine cooling water pump 211, to the control unit 11. The control unit 11 is configured to be able to detect the revolutions of the engine cooling water pump 211 (that is, whether or not the engine cooling water pump 211 is driven and rotated) based on the cooling-water-pump revolution recognition signal obtained from the internal instrument power converter 20. Accordingly, the control unit 11 can recognize that the engine cooling water pump 211 is driven and rotated. Herein, the revolutions of the engine cooling water pump 211 mean the revolutions (revolution speed) per unit time of the engine cooling water pump 211.

Also, the control unit 11 inputs the output instruction signal, indicating the output of the inverter 163 (operating the inverter 163), from the inverter output instruction port to the signal input side of the inverter 163, thereby operating the inverter 163, whereas the control unit 11 does not input the output instruction signal to the signal input side of the inverter 163, thereby preventing the inverter 163 from operating.

Regarding Present Embodiment

As described above, with respect to the engine driven heat pump 100 according to the present embodiment, after the lapse of the first predetermined time T1 (for example, 20 seconds) from the predetermined actuation time of the engine 110, the output power Pa from the generator 130 is output-controlled, and the power output control is started so as to obtain the generation power Pb, and when it is determined that the generation voltage Vb after the start of the power output control is equal to or higher than the predetermined voltage Vb1 (for example, 300 V), the engine cooling water pump 211 is driven, and after the lapse of the second predetermined time T2 (for example, 10 seconds) from the predetermined drive time of the engine cooling water pump 211, the outdoor fan 212 is driven, and after the lapse of the third predetermined time T3 (for example, 10 seconds) from the predetermined drive time of the outdoor fan 212, the output control for the inverter 163 is started, so that the engine driven heat pump 100 can provide the operational constitution regarding the timing of supplying power to the engine cooling water pump 211 and the outdoor fan 212 in the internal instrument 21, which is driven by the generation power Pb from the generator 130 at the start time of the self-sustaining operation. For example, this is more effective in a case where the generator 130 whose rated capacity is small enough to have a difficulty is used when the engine cooling water pump 211 and the outdoor fan 212, the load power of which is relatively large in the internal instrument 21, are actuated at once the start time of the self-sustaining operation (for example, the actuation of the output power Pa from the generator 130 is destabilized at the start time of the self-sustaining operation). However, the engine cooling water pump 211 and the outdoor fan 212 as the internal instrument 21 are sequentially driven, so that the initial power consumption of the power generation at the start time of the self-sustaining operation can be restrained, and the actuation of the output power Pa from the generator 130 can be stabilized at the start time of the self-sustaining operation as much.

In the present embodiment, it is preferable that the rated power consumption of the engine cooling water pump 211 be lower than the rated power consumption of the outdoor fan 212. Thus, the rated power consumption of the engine cooling water pump 211 is lower than the rated power consumption of the outdoor fan 212, so that the engine cooling water pump 211, whose rated power consumption is low, can be driven at first, out of the engine cooling water pump 211 and the outdoor fan 212 in the internal instrument 21. Accordingly, the actuation of the output power Pa from the generator 130 can be further stabilized at the start time of the self-sustaining operation.

In the present embodiment, preferably, when the generator 130 is driven without operating the compressor 120, the control unit 11 controls the operation of the outdoor fan 212 in such a manner that the upper-limit revolutions of the outdoor fan 212 set in advance, which is the upper limit value of the revolutions of the outdoor fan 212, are reduced, compared with a case where the compressor 120 is operated, and the generator 130 is driven. Thus, when the generator 130 is driven without operating the compressor 120, the upper-limit revolutions of the outdoor fan 212 is reduced, compared with the case where the compressor 120 is operated, and the generator 130 is driven, so that when the generator 130 is driven without operating the compressor 120, that is, when the generator 130 is driven without the heat pump operation (air conditioning operation in the example), the power consumption of the outdoor fan 212 can be restrained, and the surplus of supply of power to the electric power load can be increased at the start time of the self-sustaining operation as much.

The present invention is not limited to the above-mentioned embodiments, but can be executed in various forms. Accordingly, the embodiments disclosed above are mere exemplification in all the aspects, but shall not be regarded as the basis of limitative interpretation. The scope of the present invention shall be defined based on Claims, not restricted by the main paragraph of Description. Furthermore, all the modifications and changes, which are included within the scope of the equivalents to Claims, are included in the scope of the present invention.

The invention claimed is:

1. An engine driven heat pump, comprising:

an engine;

a compressor configured to be driven by the engine;

a refrigerant circuit configured to flow a refrigerant sucked and discharged by the compressor;

a generator configured to be driven by the engine;

an outdoor fan and an engine cooling water pump, each of which is configured to be driven by generation power of the generator;

an engine actuation battery configured to actuate the engine;

a battery charging circuit configured to charge the engine actuation battery; and an inverter configured to convert output power from the generator into a predetermined voltage and a predetermined frequency, and a control unit configured with programming such that wherein after a lapse of a first predetermined time from a predetermined actuation time of the engine, the output power from the generator is output-controlled by a generator controller, and a power output control is started so as to obtain the generation power, and wherein when it is determined that the generation voltage after the start of the power output control is equal to or higher than a predetermined voltage, the engine cooling water pump is driven, and wherein after a lapse of a second predetermined time from a predetermined drive time of the engine cooling water pump, the outdoor fan is driven, and wherein after a lapse of a third predetermined time from a predetermined drive time of the outdoor fan, output control of the inverter is started, and wherein when the compressor is not operated, and the generator is driven, upper-limit revolutions of the outdoor fan are reduced, compared with a case where the compressor is operated, and the generator is driven.

2. An engine driven heat pump, comprising:

an engine;

a compressor configured to be driven by the engine;

a refrigerant circuit configured to flow a refrigerant sucked and discharged by the compressor;

a generator configured to be driven by the engine;

an outdoor fan and an engine cooling water pump, each of which is configured to be driven by generation power of the generator;

an engine actuation battery configured to actuate the engine;

a battery charging circuit configured to charge the engine actuation battery; and an inverter configured to convert output power from the generator into a predetermined voltage and a predetermined frequency, and a control unit configured with programming such that wherein after a lapse of a first predetermined time from a predetermined actuation time of the engine, the output power from the generator is output-controlled by a generator controller, and a power output control is started so as to obtain the generation power, and wherein when it is determined that the generation voltage after the start of the power output control is equal to or higher than a predetermined voltage, the engine cooling water pump is driven, and wherein after a lapse of a second predetermined time from a predetermined drive time of the engine cooling water pump, the outdoor fan is driven, and wherein after a lapse of a third predetermined time from a predetermined drive time of the outdoor fan, output control of the inverter is started, and wherein rated power consumption of the engine cooling water pump is lower than rated power consumption of the outdoor fan, and wherein when the compressor is not operated, and the generator is driven, upper-limit revolutions of the outdoor fan are reduced, compared with a case where the compressor is operated, and the generator is driven.

* * * * *